US009828799B2

(12) United States Patent
Hall

(10) Patent No.: US 9,828,799 B2
(45) **Date of Patent: *Nov. 28, 2017**

(54) METHOD AND APPARATUS FOR REINFORCING ROLL UP, ROLL DOWN SHUTTERS AND DOORS USING SELF-FORMING STRUCTURAL SHAPES

(71) Applicant: Christopher J Hall, Satellite Beach, FL (US)

(72) Inventor: Christopher J Hall, Satellite Beach, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/880,414

(22) Filed: Oct. 12, 2015

(65) Prior Publication Data

US 2016/0032643 A1 Feb. 4, 2016

Related U.S. Application Data

(63) Continuation of application No. 13/909,020, filed on Jun. 3, 2013, now Pat. No. 9,157,270, which is a (Continued)

(51) Int. Cl.
*E06B 9/15* (2006.01)
*E06B 9/11* (2006.01)

(Continued)

(52) U.S. Cl.
CPC ..... *E06B 9/11* (2013.01); *E06B 9/15* (2013.01); *E06B 9/17* (2013.01); *E06B 9/34* (2013.01);

(Continued)

(58) Field of Classification Search
CPC ..... E06B 2009/1516; E06B 3/481; E06B 9/0638; E06B 9/0669; E05Y 2900/132; E05D 15/26

(Continued)

(56) References Cited

U.S. PATENT DOCUMENTS 2,912,048 A * 11/1959 Grau ..... E06B 9/165 160/133
3,302,692 A * 2/1967 Grau ..... E06B 9/34 160/133

(Continued)

FOREIGN PATENT DOCUMENTS

DE 2451189 C2 * 9/1976 ..... E06B 9/165

*Primary Examiner* — Katherine Mitchell
*Assistant Examiner* — Jeremy Ramsey
(74) *Attorney, Agent, or Firm* — John L. DeAngelis; Beusse, Wolter, Sanks, & Maire, PLLC

(57) ABSTRACT

A shutter for protecting an opening. The shutter comprising a plurality of horizontal curtain slats for covering the opening, wherein horizontal refers to a direction when viewing slats from a front surface, and wherein the curtain slats hang freely from a upper region of the opening; an upper transition slat movably affixed to a lower end of a first curtain slat; a lower transition slat movably affixed to an upper end of a second curtain slat; and a horizontal reinforcing member comprising at least an upper and a lower reinforcing slat, wherein the upper reinforcing slat is rotatably affixed to a lower end of the first transition slat and the lower reinforcing slat is rotatably affixed to an upper end of the second transition slat, and wherein the upper and lower reinforcing slats are rotatably joined.

7 Claims, 9 Drawing Sheets

Related U.S. Application Data continuation of application No. 12/705,504, filed on Feb. 12, 2010, now abandoned.

(60) Provisional application No. 61/151,499, filed on Feb. 10, 2009.

(51) Int. Cl.

| | |
|---|---|
| ***E06B 9/58*** | (2006.01) |
| ***E06B 9/17*** | (2006.01) |
| ***E06B 9/34*** | (2006.01) |
| *E06B 9/00* | (2006.01) |

(52) U.S. Cl.
CPC ..... *E06B 9/581* (2013.01); *E06B 2009/005* (2013.01); *E06B 2009/1516* (2013.01)

(58) Field of Classification Search
USPC ..... 160/183, 133, 264, 199, 206
See application file for complete search history.

(56) References Cited

U.S. PATENT DOCUMENTS

| | | | | | |
|---|---|---|---|---|---|
| 3,941,179 | A * | 3/1976 | Root | A62C 2/06 | 160/1 |
| 3,989,084 | A * | 11/1976 | Inamura | E06B 9/15 | 160/133 |
| 4,524,814 | A * | 6/1985 | Deziel | E06B 9/11 | 160/133 |
| 4,715,421 | A * | 12/1987 | Erber | E06B 9/34 | 160/133 |
| 5,586,592 | A * | 12/1996 | McGregor | E06B 9/68 | 160/133 |
| 6,085,822 | A * | 7/2000 | Miller | E06B 9/15 | 160/133 |
| 6,874,560 | B2 * | 4/2005 | Escribano | E06B 9/86 | 160/133 |
| 9,157,270 | B2 * | 10/2015 | Hall | E06B 9/15 | |
| 2005/0072089 | A1 * | 4/2005 | Wong | E06B 9/11 | 52/473 |

* cited by examiner

METHOD AND APPARATUS FOR REINFORCING ROLL UP, ROLL DOWN SHUTTERS AND DOORS USING SELF-FORMING STRUCTURAL SHAPES

CROSS REFERENCE TO RELATED APPLICATIONS

This patent application is a continuation application which claims the benefit of the patent application filed on Jun. 3, 2013, assigned application Ser. No. 13/909,020 and entitled Method and Apparatus for Reinforcing Roll Up, Roll Down Shutters and Doors Using Self-Forming Structural Shapes, set to issue as U.S. Pat. No. 9,157,270 on Oct. 13, 2015, which claims the benefit of the patent application filed on Feb. 2, 2010, assigned application Ser. No. 12/705,504 and entitled Method and Apparatus for Reinforcing Roll Up, Roll Down Shutters and Doors Using Self-Forming Structural Shapes, now abandoned, which claims the benefit of the provisional patent application No. 61/151,499 filed on Feb. 10, 2009, and entitled Method for Reinforcing Roll Up, Roll Down Shutters Using Self-Forming Structural Shapes.

FIELD OF THE INVENTION

This invention relates to methods and apparatuses related to roll-up (also known as roll-down) shutters that utilize self-forming structural shapes to reinforce the shutter to achieve structural strength for resisting forces normal to the plane of the shutter curtain beyond those achievable using uniform curtain elements deployed in a planar shape.

BACKGROUND OF THE INVENTION

Storm and/or security shutters and doors have been manufactured in a roll-up format for many years. They commonly roll up and down onto and from a take-up reel above (or below or to the sides of) the protected opening using a mechanism that turns the take-up reel and/or drives the material of the shutter directly. The material of the shutter curtain covering the protected opening is generally flat, comprising a large number of (usually identical, typically extruded metal) slats. Unique top slats may be used to interface to the take-up mechanism, and unique bottom slats may be used to seal or cushion against the surface upon which the curtain rests. Adjacent slats interlock, making a curtain whose structural strength, wind, and impact resistance is derived from the basic strength of the slats themselves.

The curtain is lowered into and rides in tracks on the sides. The tracks hold the slats in the form of a planar curtain, provide a guide for deployment, and anchor the curtain to the fixed structure surrounding the protected opening. The curtain is limited in width because the slats must accept wind loads and impacts, especially those normal to the plane of the curtain, without flexing sufficiently to touch (and break) windows, doors, etc. in the protected opening. The curtain must also resist flexing that may pull the curtain from within the tracks. As the curtain is widened to protect larger openings, it is necessary to reinforce the curtain against flexure normal to the curtain plane using storm bars (running vertically in most cases) or to break the curtain into several narrower spans, each riding between reinforcing bars or in its own set of (usually vertical) parallel edge tracks. In either case, when the curtain is retracted, the protected opening remains obstructed by the reinforcing bars or the additional tracks.

DETAILED DESCRIPTION OF THE INVENTION

Before describing in detail the particular method and apparatus related to roll-up, roll-down shutters or 'curtains' reinforced with self-forming structural shapes, it should be observed that the present invention resides primarily in a novel and non-obvious combination of elements and process steps. So as not to obscure the disclosure with details that will be readily apparent to those skilled in the art, certain conventional elements and steps have been presented with lesser detail, while the drawings and the specification describe in greater detail other elements and steps pertinent to understanding the inventions. The presented embodiments are not intended to define limits as to the structures, elements or methods of the inventions, but only to provide exemplary constructions. The embodiments are permissive rather than mandatory and illustrative rather than exhaustive.

The present invention teaches an improvement beyond the flat curtain shutter approach of the prior art as described above. According to the invention, lowering the curtain deploys shapes (also referred to as structural members, deployable slats, structural shapes, reinforcing shapes, reinforcing members, structural members, and reinforcing or structurally stiffening shapes) formed of slats that enhance the flexure strength of the curtain, providing greater resistive strength against pressure and impact, especially such forces normal to the plane of the curtain. Just as folding a flat, thin, 'floppy' sheet of sheet metal into a formed shape (such as for example, a triangular beam) greatly increases its flexure strength, so too does the creation of three dimensional beams formed of slats increase the flexure strength of a shutter containing such structural shapes. The structural shapes and the attendant increased flexure strength also allow coverage of larger shutter spans without utilizing storm bars or additional tracks across the protected opening. In an embodiment for use as a security shutter or door, this enhanced strength may be selectively used to reinforce portions of the shutter, such as a reinforced lower portion of the shutter for use as a vehicle barrier.

When used in this document, "deployable slats" generally refer to those that exit the plane of the flat curtain, rather than referring to deployability with respect to the action of simple up/down rolling/unrolling of a (planar) curtain shutter. Further, shutters are referred to as rolling up and down in the present application, but in other embodiments the shutter assemblies may be reoriented to produce a side-to-side opening/closing action with the addition of appropriate load bearing rollers, bearings, or slides on the shutter edge. This alternate construction is considered to be included whenever up and down motion is discussed. Only up/down motion is explicitly discussed herein to reduce possible reader confusion.

Figure 1:
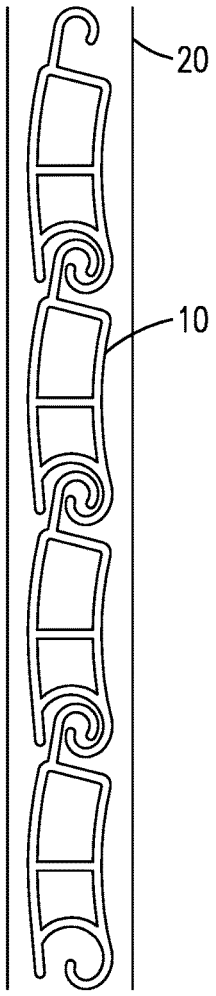
FIG. 1 PRIOR ART
FIG. 1 depicts a side view of a prior art flat roll-up curtain shutter.

Typical shutters comprise a series of interlocked identical slats 10, as shown in a side view of FIG. 1. The slats form a flat curtain that rides in and is retained at the edges in edge tracks 20. The slats are typically formed by aluminum extrusion and the side view of FIG. 1 depicts a typical current extruded shape for the slats. The strength of the curtain, especially normal to the plane of the curtain, is derived primarily from the cross-sectional shape of the slats. The prior art curtain does not provide strength enhancement as in the present invention, where the strength enhancement is derived from the formation of structural shapes from the slats, as the curtain is rolled down into place over the protected opening.

McGregor, in U.S. Pat. No. 5,586,592, discloses the use of simple corrugations in the curtain, which help to some degree, but require compressive loading on the curtain and a corresponding complex tractor mechanism to retain the shape. This feature is not required according to the present invention.

In fact, in the present invention, the weight of the descending slats above should generally be sufficient to deploy and form the desired structural shapes. Also in McGregor, the compressive loading mechanism needs to be strong enough to withstand the upward force on the curtain generated during impacts or application of pressure to the shutter's protruding corrugations. The structural shapes and approaches taught in the present invention generate little or no upward force to the curtain during impacts, so a compressive loading mechanism is not required. A mechanism to lock the curtain in place may be desired in some embodiments for additional strength and/or security, especially when the shutter is used for security rather than storm protection purposes.

Figure 2:
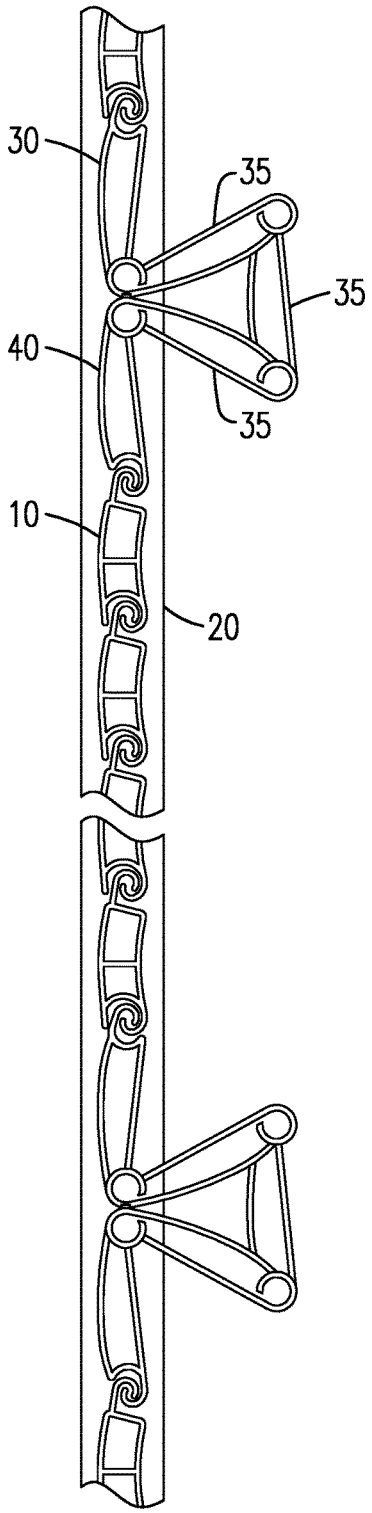
FIG. 2 depicts a side view of a shutter with deployable stiffening slats of the present invention.

FIG. 2 shows a side view (not to the same scale as FIG. 1) of one possible reinforcing shape of the present invention. These reinforcing or structurally stiffening shapes add strength beyond that achieved by a flat curtain. As illustrated, the slats 10 of the shutter curtain are punctuated by one or more triangular beams formed by deployable slats 35 as the shutter is lowered. Slats 30 and 40 provide a transition between the flat curtain slats 10 and the deployable slats 35. Articulating elements (e.g., hinges or pivots capable of achieving desired pivot angles) used between the flat curtain slats of many current production shutters are unable to sustain longitudinal loads or achieve the desired pivot angles needed to form the beams so transition slats 30 and 40, as well as beam forming slats 35 with appropriate articulating elements must be utilized. (If an embodiment is designed with this capability in mind from initial design, slats 30, 35, and 40 may be similar or identical to those slats 10 used to form the curtain, except for slat sorting provisions described later herein.) Such beams or structural shapes inherently resist curtain flexure to a far greater degree than flat slats alone. These shapes disappear into an essentially flat curtain as the shutter is raised, and the slats 30, 35, 40 roll up with the rest of the curtain slats onto the reel above (or to the side of) the protected opening.

In one embodiment, the present invention may be practiced in a retrofit situation or with existing flat curtain slat designs, and thus FIG. 2 illustrates prior art curtain slats 10 to indicate compatibility.

Figure 3:
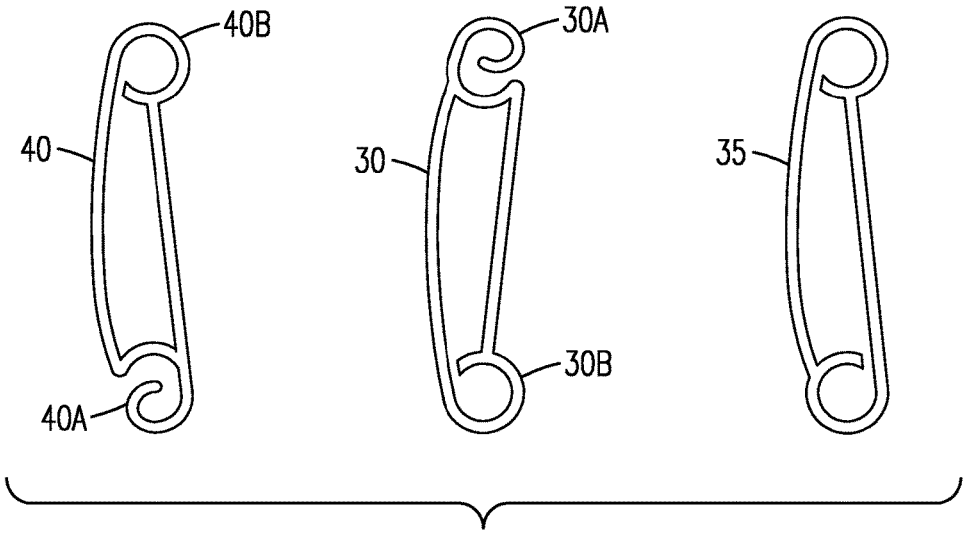
FIG. 3 depicts a side view of exemplary transition slats and deployable slats.

Example transition slats 30 and 40 and a beam forming slat 35 are shown in greater detail in FIG. 3. The upper and lower transition slats 30 and 40 are compatible with and mate to the flat curtain slats. FIG. 3 also illustrates a possible shape for the deployable slats 35. Note the slats in FIG. 3 may have different cross sectional dimensions and shapes than the slats comprising the flat curtain. Also note that the slats 30 and 40 are asymmetric, but in another embodiment two symmetric hinges can be used to interface to the upper and lower curtain slats. For example, one symmetric embodiment may comprise slats that are rectangular in cross-section, which may permit the slats 30 and 40 to have a similar or identical cross-sectional shape.

The upper interface between the curtain slats and the structural shape in FIG. 2 is formed by the slat 30, which interfaces to the curtain slat above at an upper slat edge 30A. A piano hinge in one embodiment, is present at a lower edge 30B of the slat 30 for mating with one of the beam slats 35. The lower interface between the curtain slats and the structural shape is formed by the slat 40, which interfaces to the curtain slat below at a lower edge 40A. A piano hinge is present at an upper edge 40B. The slats 35, with a double piano hinge, complete the structural shape.

In some embodiments, all slats may use the piano hinges (as in the slat 35 of FIG. 3), possibly removing the need for some of the unique slat shapes used in the example, and permitting a single, common shape to be used. Such an embodiment may be incompatible with current production curtain slats, however, making such an embodiment potentially less attractive to some manufacturers.

In this non-limiting example, the various slat cross-sections shown utilize a uniform height (measured from a lower edge of the slat to an upper edge of the slat) and width (measured from a front surface of the slat to a rear surface of the slat), but the slats 30, 35, and 40 may each have a unique cross section, different heights, different widths, and/or more curvatures than the flat curtain slats 10. A different curvature may add strength and/or enable improved packing of the shutter as it is rolled into its take-up mechanism.

The term piano hinge is used herein to encompass various articulating elements, articulating shapes, pivoting shapes, and or hinges. In some embodiments, this piano hinge may also be required to accept longitudinal loads (into/out of the paper in the side views of FIGS. 1 through 3) to assure the structural integrity of the formed structural shapes or beams.

Figure 4:
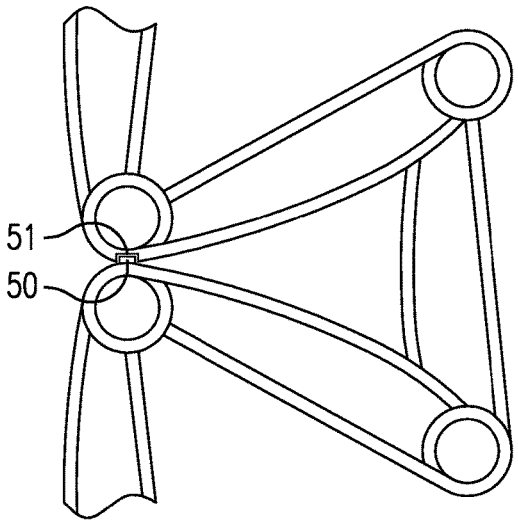
FIG. 4 depicts a side view of exemplary interlocking shapes.
Figure 5A:
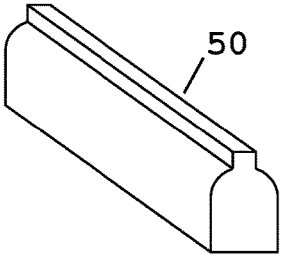
FIGS. 5A through 5H depict oblique views of exemplary interlocking shapes.
Figure 5B:
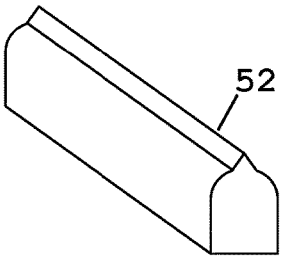
Figure 5C:
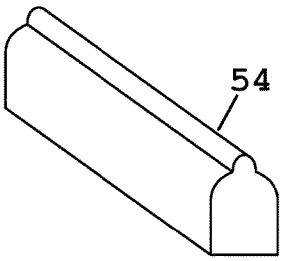
Figure 5D:
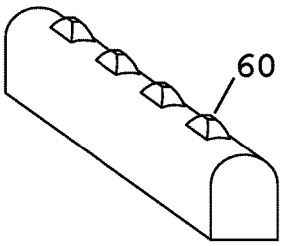
Figure 5E:
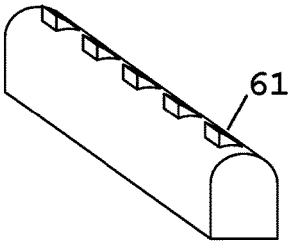
Figure 5F:
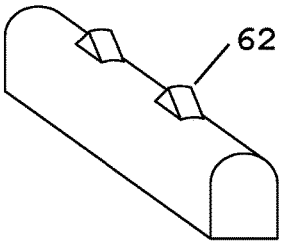
Figure 5G:
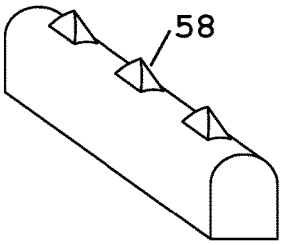
Figure 5H:
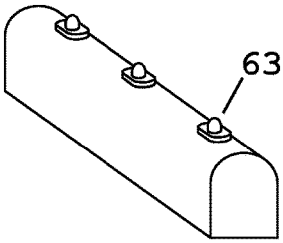

The articulating elements that function in a manner similar to a piano hinge allow the structural shape to be formed as the shutter is lowered. The transition slats (and in one embodiment, the beam forming slats) may include interlocking members to transfer loads normal to the plane of the curtain, and in some embodiments loads longitudinally along the slats, for purposes that may include retention of the curtain and structural shape elements in appropriate relationships and to provide integrity to the formed beams. These interlocking members may be located on the slats forming the deployed shape and on a surface of a flat curtain slat that mates with one of the slats forming the deployed shape, i.e., slats 30 and 40 above and below the deployed shape. See FIG. 2. The interlocking member may, for example, comprise a rectangular nub 50 and a matching slot 51 as shown in FIG. 4.

These interlocking members lock the slats together and enhance the strength of the formed beam, especially with regard to forces applied perpendicular to the plane of the curtain. Note that if a piano hinge is used, the interlocking shapes may not be present on either/both elements ('halves') of a given hinge, to allow for the rotation of some elements during locking/unlocking of the shapes applied to other elements.

Greater design loads and/or spans may be achieved by the present invention by more closely spacing the multiple reinforcing beams, with fewer flat curtain slats between the deployed beams. Indeed, the strength of the shutter may be manipulated by changing the type and spacing of the beams within the shutter.

To provide the needed deployability, the needed longitudinal interlock strength, and the needed beam integrity, a multiplicity of locking shapes may be used in various embodiments. FIGS. 5A through 5H show non-limiting examples of locking shapes, including the rectangular nub 50, a triangular nub 52, and a cylindrical nub 54. The inverse mating shapes are implied, rather than shown explicitly herein. The nubs 50, 52, and 54, and other shapes not illustrated, can be formed as the slats are extruded. More complex shapes may also be used, including (as non limiting examples) spherical bumps 56, pyramids or cones 58, or a combination of shapes such as 60, 61, 62 (and their corresponding inverse indentations or openings on mating surfaces of adjacent slats) to provide the desired locking strength both longitudinally along the slats, and normal to the plane of the curtain.

Figure 6:
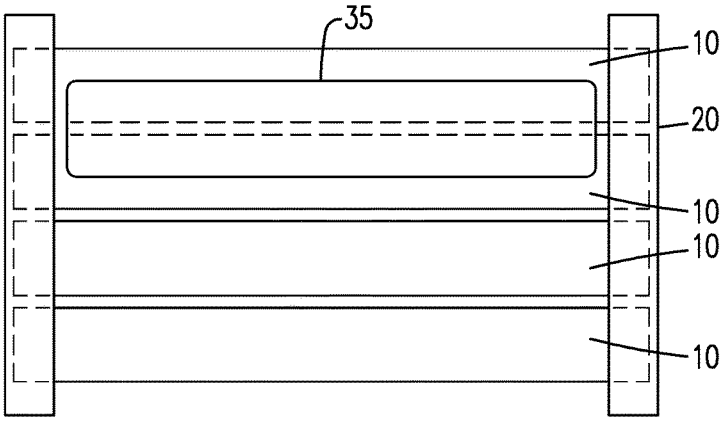
FIG. 6 depicts a view from outside of a shutter curtain comprising deployable slats according to the present invention.

While the flat curtain slats slide in a fixed track in a planar fashion over the protected opening, the deployable slats must exit this plane to form the shaped beam with a depth as indicated. This may be accomplished, according to one embodiment, by making the deployable slats shorter than the curtain slats. The shorter slats are therefore not retained inside the edge track 20, shown in front view in FIG. 6. FIG. 6 illustrates the deployable slats 35 extending closer to the viewer than the curtain slats 10, which are retained entirely in the side tracks 20. Note that such implementations must include a positional indexing or retaining element to prevent the shorter slats from sliding horizontally and impinging the side tracks 20.

Note that McGregor teaches a required multipart track, with shorter slats exiting the rear slot, but being retained by the forward edge of the "E" shaped side track. While the current invention, in some embodiments, may use such an "E" shaped track for aesthetics, personnel safety, or additional strength, it is not required by the present invention. The track in the present invention may provide a simple, single rectangular slot as with typical flat curtain shutters, and the beams formed may be essentially external to the track.

The shorter-slats embodiment may utilize springs or other simple mechanisms to assure that the shorter slats properly exit the plane of the track to create the reinforcing member. This embodiment may also use offset pivots so the force (including slats weight) of the slats descending from above provides the moment necessary to assure that they exit the plane of the curtain and deploy.

Figure 8:
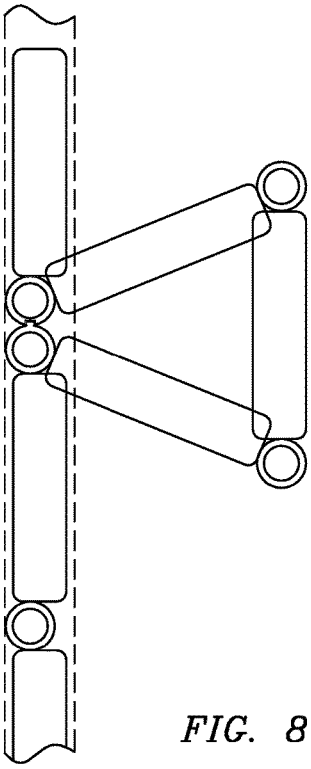
FIG. 8 depict a side view of exemplary deployable slats with offset pivot points to aid deployment.
Figure 7:
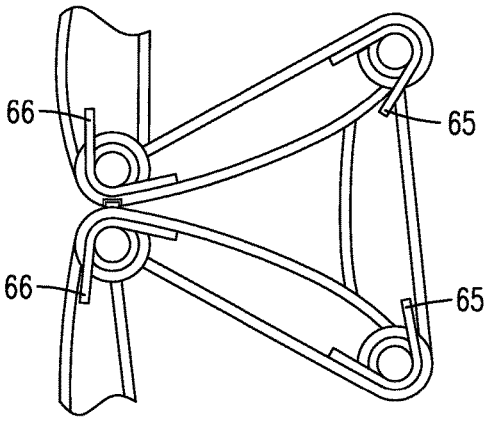
FIG. 7 depicts a side view of exemplary deployable slats including springs to aid deployment.

FIG. 7 shows a non-limiting example of deployable slats with springs 65 and or springs 66 to help the slats exit the plane of the curtain, and form the beam. FIG. 8 shows an alternate embodiment in which offset pivot points on the transition and deployable slats generate the necessary moment to 'open' the shape and form the beam(s). In some embodiments, both these methods may be combined, and or additional springs, compressible bumpers, or simple mechanisms may be used to provide the required 'nudge' out of planar form, to allow the shapes to be formed (usually using the weight of the elements above) into the desired beams.

Figure 9A:
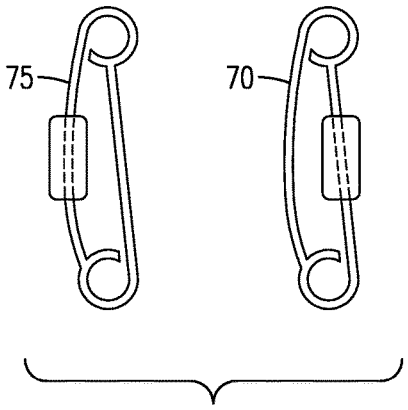
FIG. 9A-9D depict exemplary deployable slats, with FIGS. 9A and 9C each depicting a side view and FIGS. 9B and 9D each depicting a top view.
Figure 9B:
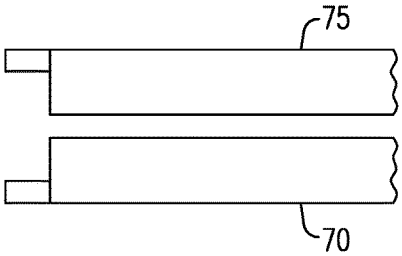

Another non-limiting embodiment is to use deployable slats of essentially the same length as the curtain slats (that is, both types being long enough to be positively retained within the side tracks), and adding a sorting mechanism as shown in FIGS. 9A-9D and FIG. 10*a* to 'kick out' the deployable slats 70 from the track, while leaving the remaining flat curtain slats 75 in the track. FIG. 9A shows slats in an end view and FIG. 9B shows slats in a top view, with extended tabs attached to or integrated onto the slat ends (shown as thicker or darker edges in the illustration end view), which in some embodiments may have a low friction strip or coating applied to assure smooth motion.

Figure 9C:
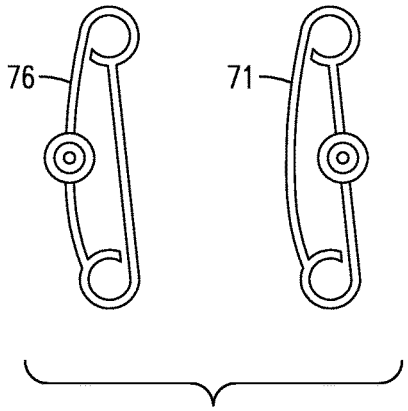
Figure 9D:
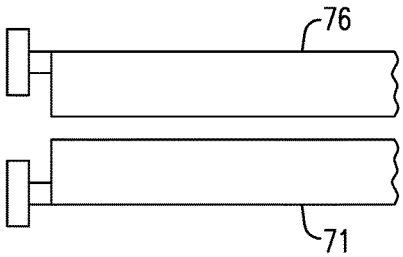

In another embodiment, FIG. 9C shows slats in an end view and FIG. 9D shows slats in a top view, with offset rollers instead of tabs on the slat ends, to provide the sorting action with possibly lower friction. In some embodiments, such added clips, slides, or rollers may be added to slat ends by inserting these assemblies into the (usually extruded and open) ends of the slats, to allow these items to be added to slats in the field to provide the differentiation and sorting action.

The deployable slats ride inside the edge tracks with the curtain slats to a point of deployment, where edge tabs, rollers, or another separating or differentiating mechanism drives the deployable slats out of opening(s) in the tracks, and out from the plane of the curtain, and retracts them back into the curtain plane during shutter retraction.

Figures 10A, 10B:
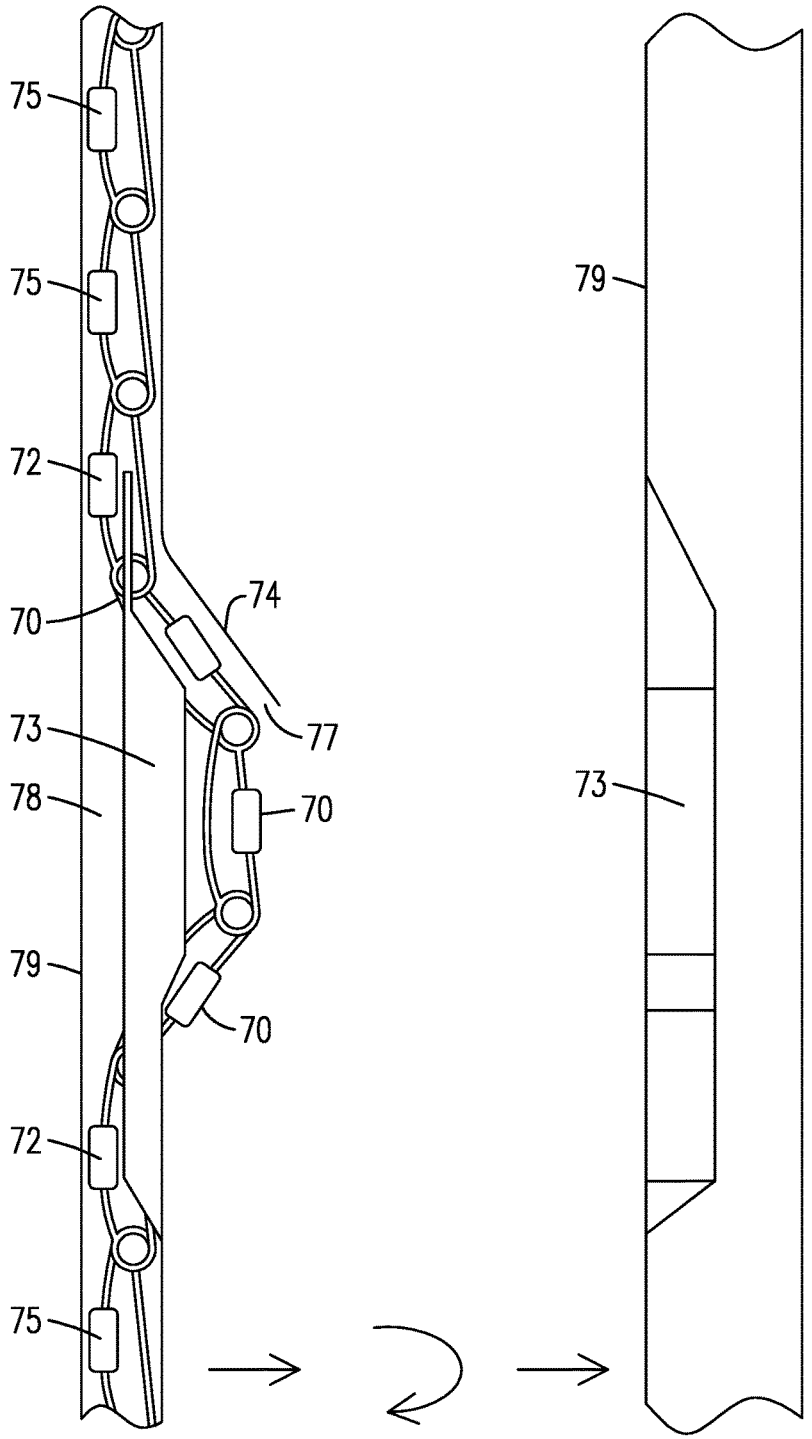
FIGS. 10A and 10B depict respective side and front views of an exemplary slat sorting mechanism.

FIG. 10A shows a side view of a partially lowered shutter with deployable slats 70 beginning to emerge from the track 79 through an opening 77 in a forward face of the track, while curtain slats 75 and transition slats 72 remain inside the track with tabs riding in the slot 78 behind the sorting device. FIG. 10A also shows a simple non-limiting example of a sorting ramp 73 included in or attached inside the track 79 to engage the tabs, rollers, or other sorting features attached to the slats.

Note that transition slats 72 in this figure correspond in function to slats 30 and 40 described in previous figures. In various embodiments these two transition slats may be two unique, different shapes as in FIG. 3, a single shape, or even identical to the curtain slats 75. The differentiating factor generally lies within the specific embodiments of articulating elements used in the various slats, and potentially compatibility with a locking track described in FIG. 14 below.

This sorting mechanism 73 may, in some embodiments, be added to current typical track extrusions by simply attaching the sorting ramp 73 to the track, cutting the front face of a section of the track and either attaching ramp 74 or bending upward the cut section to form ramp 74. In this non limiting example these ramp guides the deployable elements from the track during lowering, and guides the elements back into the track as the shutter is raised.

Another guide may be desirable, in some embodiments, at the top of the track cutout 74 to aid the slats in re-entering the track when it is being rolled up. For simplicity, additional guides or rollers or simple mechanisms that may be added to assure smooth operation and deployment in various embodiments have been omitted, however they may be required for smooth operation, without digressing from the scope of the present invention. Note that the sorting ramp or mechanism 73 is shown as a simple polygon, but the faces may be curved or otherwise shaped for smoother operation in some embodiments, and may be made of a low friction material, or coated therewith. In some embodiments, the transition slats 72 may serve the functions discussed for slats 30 and 40 in FIG. 3, and may not be identical. Deployable slats 70 may be functionally equivalent to slat 35 in FIG. 3.

FIG. 10B shows a non limiting example of the front view of the sorting device 73 in track 79. This or another profile may provide a sorting mechanism that allows the use of unmodified (typical current production) slats for the curtain slats 75 without added tabs, rollers, etc., with selection devices added only to the deployable and possibly transition slats. Such an implementation may require curtain slats 75 to have a slightly shorter overall length to ride inside the selection device 73.

Figure 11A:
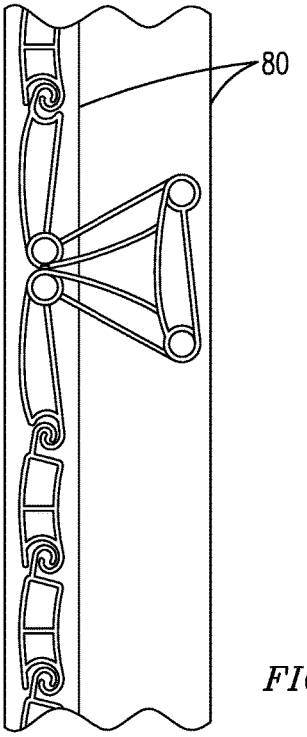
FIGS. 11A and 11B depict in side and top views respectively, a shutter with an optional dual slot edge track to further support the edges of formed reinforcing beams.
Figure 11B:
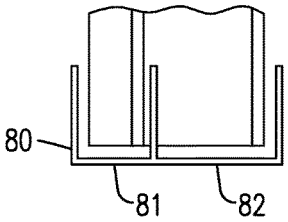

FIGS. 11A (side view) and 11B (top view) shows another embodiment in which a variation of a two channel track 80 has a relatively narrow slot 81 to contain curtain slats, and a second, wider slot 82 to contain the front of the deployed shape to further enhance retention. Such deeper tracks, while practical, are viewed as less likely to be a popular embodiment unless the sides of the track are attached directly to walls perpendicular to the shutter curtain, as in a tunnel or some garage entrances. Note too, that such an embodiment may have greater usefulness where the wider secondary retention slot 82 is oriented on the 'inside' of the shutter, where it could provide additional impact resistance against impacts applied to the flat surface of the deployed shutter, that is, from the left as viewed in FIG. 11A and FIG. 11B in applications such as vehicle barriers. While the use of a two channel track appears similar to McGregor, we note that it is not required for proper functioning of the current invention, as it was in McGregor. It is observed as a possible embodiment simply to further retain the structural beams formed, and enhance overall strength further.

Note too that this document refers to the structural shapes being deployed to the outside or front of the protected opening, as with a window or sliding door, to allow the track to be mounted with a low profile from the supporting wall, but in some embodiments, where depth behind or inside the protected opening is less restricted, the deployed shapes may be oriented to the inside of the protected opening instead, providing a more seamless exterior appearance.

Various strength-enhancing shapes may be formed by the deployable slats. Four non-limiting examples are shown in FIGS. 12A-12D. Note that the rectangular or square beam shape 90 at FIG. 12A above may require either travel-limited hinges or pivoting shapes that have interfering elements to provide a positive stop at roughly 90 degrees of flexure in the desired directions to form the shape, or spacing tabs or projections 95 on the slats to the flat curtain to provide a stop in the desired shape without interfering with the deployable slats during rolling onto the reel or while retracted 'flat' into the track.

Figure 12A:
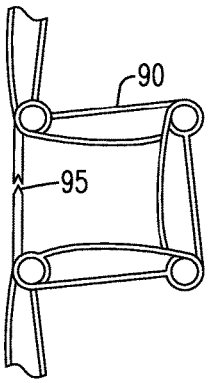
FIGS. 12A-12D depict side views of several exemplary strength-enhancing beam shapes.
Figure 12B:
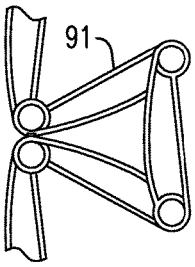

Other shapes such as the triangular beam 91 in FIG. 12B do not necessarily require hinges with positive stops, and as a result may be inherently stronger, however this embodiment may utilize locking shapes, such as those described earlier, and shown in FIG. 4 and FIG. 5 to stabilize the beam further under load or impact.

Figure 12C:
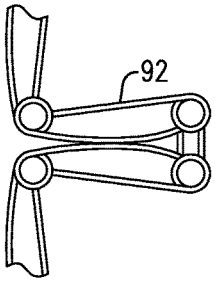
Figure 12D:
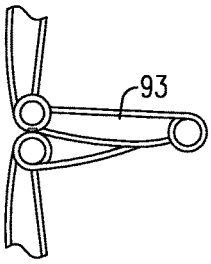

The rectangular shape 92 of FIG. 12C is included as another non-limiting example and to show that more complex shapes are possible. This non limiting example also utilizes non-uniform slat heights and widths, which is a concept applicable to various shapes. For instance, the triangular beam 91 in FIG. 12B may be equilateral or isosceles in shape and the slats may have very different heights and thicknesses than curtain slats.

This invention anticipates almost limitless variety in formed shapes, utilizing various combinations of slat heights and thicknesses, combined with indexing stops 95 (see FIG. 12A) or travel-limited pivots or hinges to form the shapes. Indeed deployed shapes (beams) may be adapted for particular applied load characteristics, applications, and aesthetics.

Note that while the term 'piano hinge' is utilized herein, interlocking shapes, pivots or hinges and/or articulating elements that join the slats across their length and allow the desired shape to be formed may take various forms, provided they permit the desired range and or limits of motion (articulation between slats), and where required, support for loads lengthwise (longitudinally) along the slats. Some reinforcing shapes (beams) require longitudinal loads to be borne by articulating and or interlocking elements to achieve full structural strength in the beam. These longitudinal loads would be viewed as into/out of the paper in the side view figures herein.

In an embodiment for use as a storm shutter, the deployable shapes are likely to be used at relatively regular spacing across the height of the shutter curtain, to accept wind loads (and/or impacts) evenly across the shutter curtain, and/or for aesthetic reasons. This need not be the case in all embodiments, however. If used as a security shutter or door, reinforcement may be desired mainly in specific areas, for example the bottom few feet, to act as a vehicle barrier. As a vehicle barrier, the upper region of the shutter may be unreinforced or may have less reinforcement, with multiple reinforcing shapes deployed close together or touching in the lower portion of the curtain. This configuration provides a very high impact resistance in the lower portion, which might be subjected to vehicle impact. Thus as illustrated by this example, various strengths may be selectively used in various portions of the same shutter or door.

Figure 13A:
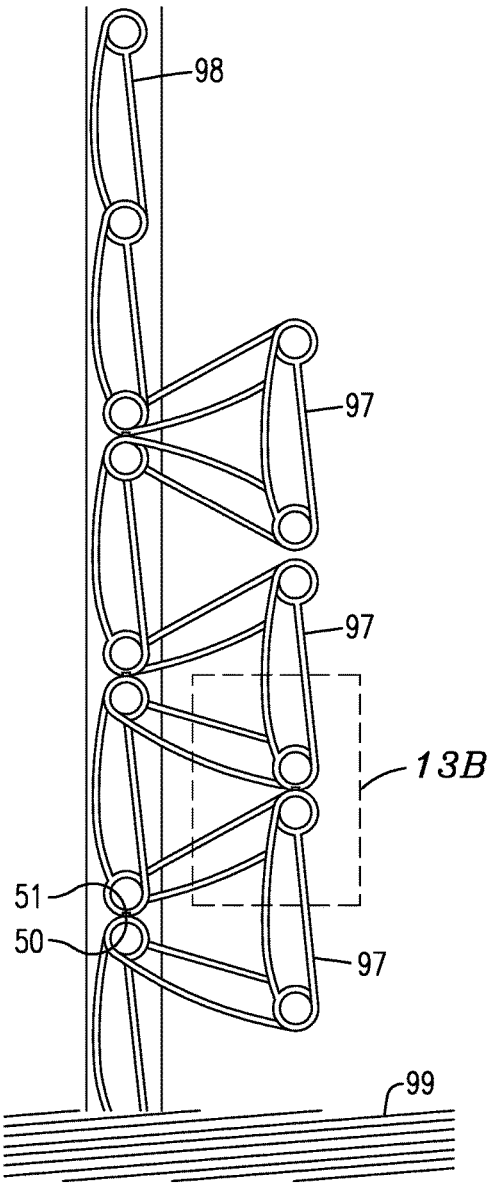
FIGS. 13A and 13B depict a side view and a close-up view of an embodiment for use as a security vehicle barrier.
Figure 13B:
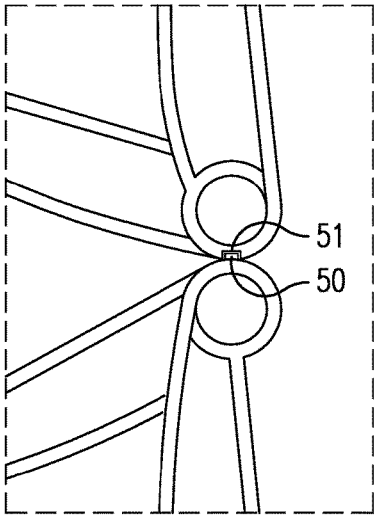

FIG. 13A shows a non-limiting example of a shutter in an edge view with deployed structural shapes 97 close together or actually touching, to create a highly reinforced lower portion of the shutter as a vehicle barrier, i.e., near the ground or pavement 99, with a simple flat curtain 98 above, for a protected access opening, such as an parking garage. Note that one non-limiting embodiment depicted in FIG. 13A also includes interlocking shapes 50 and 51 in the deployed (rightmost portion in FIG. 13A) slats, interlocking the triangular beams along their front face as detailed in FIG. 13B, and creating a composite series of interlocked triangular beams for even greater strength. Other variations on this theme are possible, utilizing other interlocking shapes as shown in FIG. 5, and it is noted note that the deployed shapes may be outside the protected opening, or inside where space permits, giving a more seamless exterior appearance.

In its embodiment as a security shutter, it may also be preferred to utilize heavier/stronger materials such as steel or titanium for the deployed shapes for additional strength, and lighter/weaker materials such as aluminum for the flat curtain. If extruded shapes are used for slats, deployable elements may have significantly different cross sections and dimensions than curtain slats, and they may be filled with relatively incompressible material to add to their deformation resistance.

In some cases, additional weight may be added to slats above and or below deployable elements to provide more positive deployment/retraction of shapes, though this adds to the load the take-up mechanism must accept, which may be undesirable in certain installations.

Locking elements (deadbolts or similar, manually or automatically operated) may be added to the track assembly or deployment mechanism, near the top of the deployed shutter, for example, to provide greater security and/or greater resistance to deformation of the deployed shapes in the event of a heavy blow or structural load that contains a force vector tending to unlock or unfold the deployed structural shapes.

Figure 14:
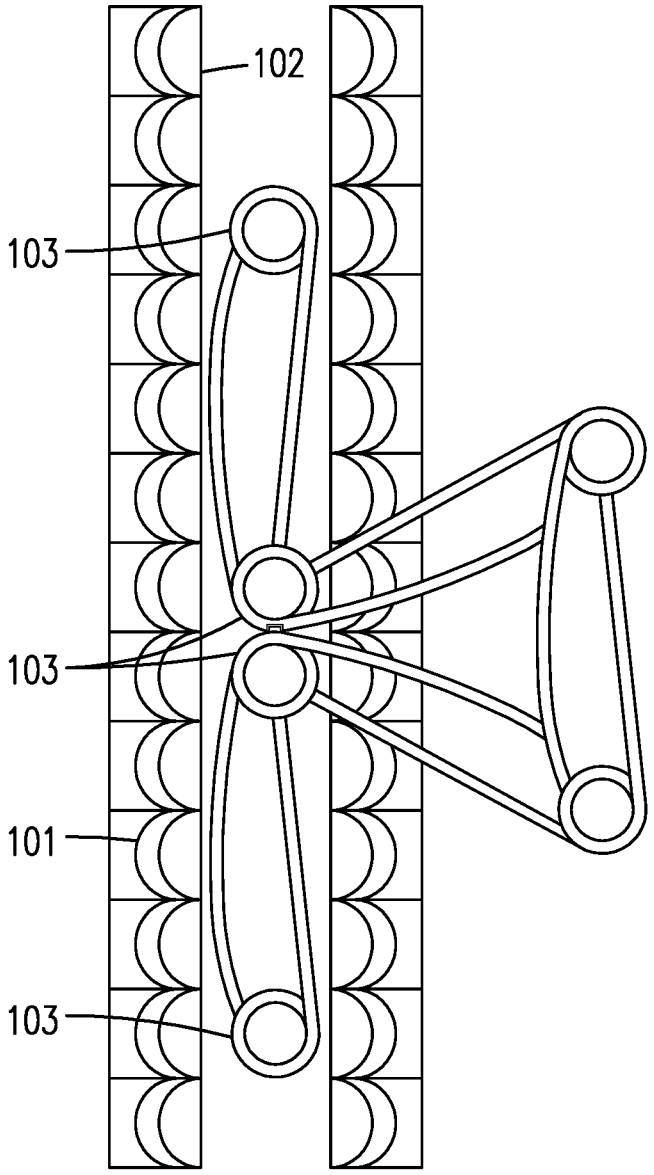
FIG. 14 depicts a side view of an exemplary passive slat locking track.

Another passive slat locking embodiment utilizes shapes in the track itself that accept the slats in the event of a heavy load perpendicular to the plane of curtain, but still provide smooth motion when no perpendicular load is present. FIG. 14 shows a side view of a non-limiting example of an alternate edge track implementation that allows the slats to slide normally up and down when not being subjected to a force normal to the plane of the curtain and that grabs slats or attached tabs or rollers to prevent vertical movement during impacts or when high loads are applied normal to the plane of the curtain. This action provides additional stability to prevent the reinforcing shapes from unfolding.

This embodiment of FIG. 14 comprises curved teeth 101 covered by a deformable guide 102, made of stiff but deformable and resilient plastic, for example, that allows smooth motion until a heavy load is applied, in which case the guide conforms to the teeth 101 and allows the slats themselves, slat pivot points 103, and/or slat sorting deployment rollers, tabs, etc. depending upon embodiment, to engage the teeth 101 to prevent vertical motion of the slats. Note this is a non-limiting example. The track may alternately engage the slats with other shapes such as rectangular teeth, triangular shaped teeth, etc. matched to the specific embodiment of the shutter. Likewise, other simple guide mechanisms may be used in place of a plastic strip 102 to prevent engagement of the teeth when no large load is present. According to this embodiment, the loads against the slats (from wind, impact, etc.) forces the slats into a shaped track that passively 'latches' or retains the track against vertical movement until that load is removed, at which time the shutter is again free to be retracted.

As used herein, the term "slat length" refers a distance between slat ends, i.e., the distance across the opening covered by the shutter plus additional allowance for track engagement, etc. The slat height refers to the distance from a bottom surface to a top surface of an individual slat. A reference to "horizontal" herein refers to a horizontal direction when viewing the slats from a front surface of the shutter curtain.

It is noted that compressive loading of the shutter is not required; it is not necessary to deploy the shutter array using a tractor mechanism to vertically load the shutter curtain. The shutter may simply hang free from an upper region of the protected opening and rest against a surface below a bottom region of the opening. Thus when in position to protect the opening, the primary upward forces exerted on the shutter are those supplied at the upper region, for example as exerted by the wind up/wind down mechanism.

While the invention has been described with reference to preferred embodiments, it will be understood by those skilled in the art that various changes may be made and equivalent elements may be substituted for elements thereof without departing from the scope of the present invention. The scope of the present invention further includes any combination of the elements from the various embodiments set forth herein. In addition, modifications may be made to adapt a particular situation to the teachings of the present invention without departing from its essential scope. Therefore, it is intended that the invention not be limited to the particular embodiment disclosed as the best mode contemplated for carrying out this invention, but that the invention will include all embodiments falling within the scope of the appended claims.

What is claimed is:

1. A shutter for protecting an opening, the shutter comprising:

first and second tracks disposed on opposing sides of the opening;

a plurality of horizontal curtain slats disposed between the first and second tracks for covering the opening, and wherein the curtain slats descend from an upper region of the opening;

an upper transition slat movably affixed to a lower end of a first curtain slat;

a lower transition slat movably affixed to an upper end of a second curtain slat;

one or more deployable slats which upon deployment form a reinforcing member, the one or more deployable slats comprising at least an upper and a lower deployable slat, wherein the upper deployable slat is rotatably affixed to a lower end of the upper transition slat and the lower deployable slat is rotatably affixed to an upper end of the lower transition slat;

a first and a second sorting mechanism disposed on each of the respective first and second tracks;

the curtain slats, the upper and lower transition slats and the one or more deployable slats vertically moveable within the first and second tracks, the one or more deployable slats deployed outwardly from the first and second tracks by action of the sorting mechanism without requiring the use of a tractor mechanism to vertically load the shutter, such that in a deployed condition the one or more deployable slats extend from a vertical plane of the shutter curtain and extend out from the first and second tracks into empty space proximate the shutter;

wherein the lower end of the upper transition slat and the upper end of the lower transition slat include an interlocking member to lock the lower end of the upper transition slat and the upper end of the lower transition slot to enhance a strength of the shutter with respect to forces perpendicular to a plane of the curtain slats; and wherein the interlocking member includes one or more protrusions on one of the lower end of the upper transition slat and the upper end of the lower transition slat and an opening sized to receive the one or more protrusions on another of the lower end of the upper transition slat and the upper end of the lower transition slat.

2. The shutter of claim 1 wherein the upper transition slat and the first curtain slat are movably affixed by a first articulating element and the lower transition slat and the second curtain slat are movably affixed by a second articulating element, the first and second articulating elements cooperating with the first and second sorting mechanism causing the upper and lower reinforcing slats to extend from a plane of the shutter curtain as the shutter is lowered across the opening.

3. The shutter of claim 1 wherein the reinforcing member comprises two reinforcing slats each attached to one of the upper and lower transition slats.

4. The shutter of claim 1 a first end of the upper reinforcing slat joined to the upper transition slat by a first articulating element, a first end of the lower reinforcing slat joined to the lower transition slat by a second articulating element, a second end of the upper reinforcing slat joined to a first end of an intermediate slat by a third articulating element and a second end of the lower reinforcing slat joined to the second end of the intermediate slay by a fourth articulating element.

5. The shutter of claim 4 wherein one or more of the first, second, third and fourth articulating elements each comprises a piano hinge or other structure capable of supporting a longitudinal interlock load along the length of the slats.

6. The shutter of claim 1 wherein the opening comprises a window, a door or a protected access opening.

7. The shutter of claim 1 the first and second tracks each further comprising a single track or a double track mounted to opposing surfaces of the opening, wherein the curtain slats travel within the single or double track and the upper and lower reinforcing members are extended from the single or into the second channel of a double track as the shutter is lowered across the opening.

* * * * *